United States Patent [19]

Khoury

[11] 4,022,346

[45] May 10, 1977

[54] HOLD DOWN MECHANISM FOR LANCED TAB

[75] Inventor: Nick S. Khoury, Worth, Ill.

[73] Assignee: The Continental Group, Inc., New York, N.Y.

[22] Filed: May 10, 1976

[21] Appl. No.: 684,685

[52] U.S. Cl. ..... 220/273; 220/375
[51] Int. Cl.[2] ..... B65D 41/32
[58] Field of Search ..... 220/269–274, 220/375

[56] References Cited

UNITED STATES PATENTS

| | | | |
|---|---|---|---|
| 3,684,126 | 8/1972 | Reichert | 220/273 |
| 3,843,012 | 10/1974 | Brown | 220/269 |

*Primary Examiner*—George T. Hall
*Attorney, Agent, or Firm*—Paul J. Lerner; Joseph E. Kerwin; John J. Kowalik

[57] ABSTRACT

An improved easy-opening end closure of the full panel pull-out type, wherein the pull tab includes an integral tether cooperating with the tab attachment rivet to redistribute the opening stresses impressed on the pull tab during opening, whereby tearing of the pull tab is prevented.

10 Claims, 4 Drawing Figures

HOLD DOWN MECHANISM FOR LANCED TAB

BACKGROUND AND SUMMARY OF THE INVENTION

The present invention relates to containers and the like and is particularly concerned with containers having easy-open closure means.

End closures of the full panel pull-out type frequently employ a pull tab having an intergrally formed hingeable panel member providing for a measure of displacement of the tab relative to the end panel. Unfortunately, the stresses impressed on the tab during opening of the closure are often such as to cause tearing of the hinge portion thereof, resulting in malfunction of the closure.

It is therefore a primary object of the present invention to provide an improved full panel pull-out type end closure wherein tearing of the pull tab is prevented.

This is accomplished by providing a pull tab having an integrally formed force-distribution tether cooperating with the tab securing means to reduce the stresses impressed on the hinge portion during openings.

Reference is herein made to my co-pending U.S. application Ser. No. 684,620 filed herewith in the name of Nick S. Khoury and entitled *Non-Obstructing End Closure*.

BRIEF DESCRIPTION OF THE DRAWINGS

With the above and other objects in view that will hereinafter, the nature of the invention will be more clearly understood by reference to the following description when viewed light of the accompanying drawings, in which.

DESCRIPTION OF THE PREFERRED EMBODIMENT

Figure 1:
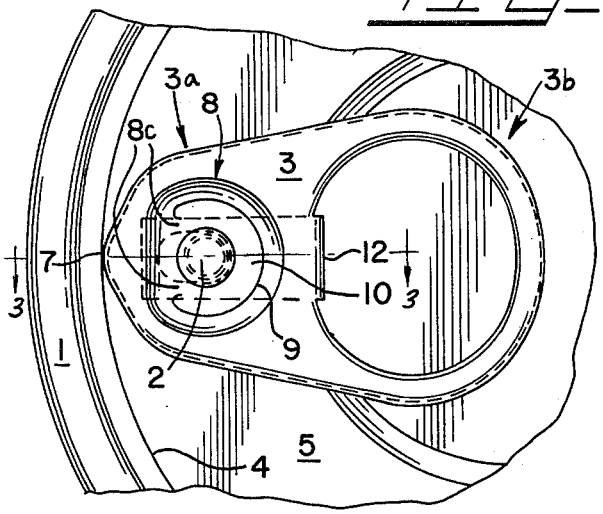
FIG. 1 is a fragmentary top plan view of the end closure of the present invention.

As shown in the drawings, the improved easy-open end closure of this invention comprises an end panel 1 having an intergrally formed rivet 2 and a pull tab 3 fixedly attached to the end panel 1 by the rivet 2. A score line 4 is formed in the end panel 1 and encircles an opening flap 5.

Figure 2:
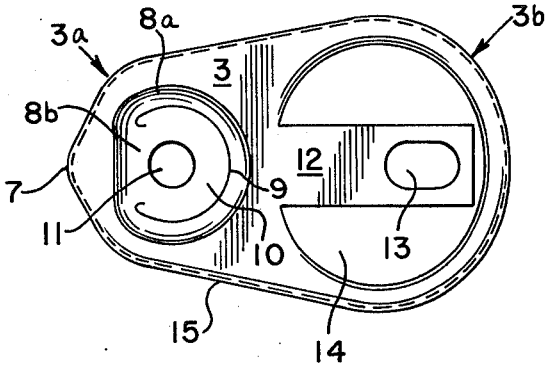
FIG. 2 is a top plan view of the pull tab of the closure of FIG. 1 prior to assembly to the end panel.
Figure 3:
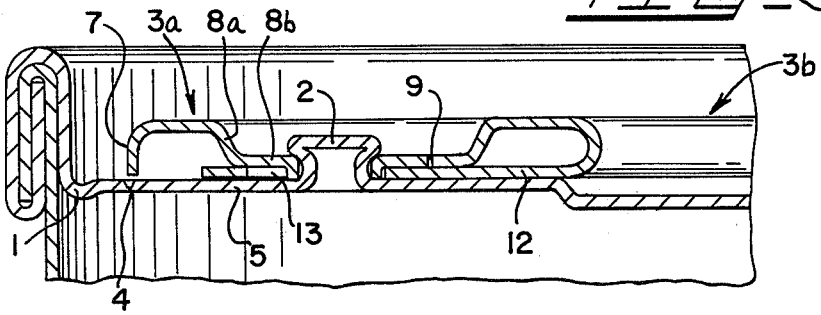
FIG. 3 is a fragmentary cross-sectional view taken substantially along the line 3—3 of FIG. 1, illustrating the end closure in the unopened condition.
Figure 4:
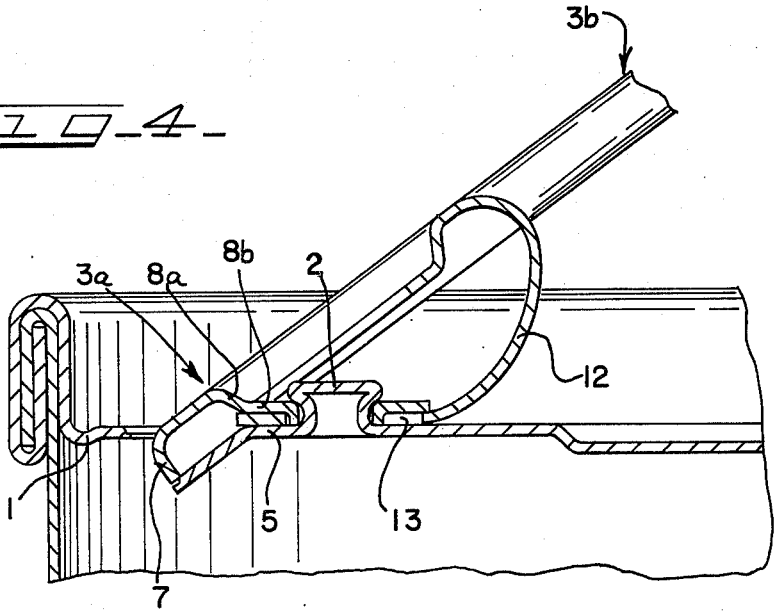
FIG. 4 is a fragmentary cross-sectional view similar to FIG. 3, illustrating the end closure in a partially opened condition.

As best shown in FIG. 2, the pull tab 3 comprises a nose portion **3*a* and a grasping portion 3*b***.

The nose portion **3*a* includes a rupturing member 7 overlying the score line 4 and a generally circular recessed rivet well 8. The well 8 comprises a sloped sidewall 8*a* and a substantially horizontal base 8*b*. A generally horseshoe-shaped slit 9 is formed in the base 8*b*, opening toward the rupturing member 7, and defining a hingeable panel member 10. The panel member 10 is integrally connected to the remainder of the rivet well base 8*b* by an unslit area 8*c* in the panel member perimeter. Located in the well base 8*b*, is a hole 11 of a size to admit the shank of the rivet 2**, but not the rivet head.

A tether 12 is integrally connected to the nose portion **3*a* on the side thereof away from the rupturing member 7. A slot 13 is formed in the tether 12, elongated along the axis of the tab 3 and being of a width to permit the passage of the shank of the rivet 2**, but not the rivet head.

The grasping portion **3*b* comprises a substantially C-shaped handle member which combines with the nose portion 3*a* to define an aperture 14 through the tab 3. During the formation of the tab 3 from a single piece of sheet metal, the tether 12 is formed of material displaced to form the aperture 14**.

A panelwardly directed rigidifying curl 15 is formed in the periphery of the tab 3 and protects the user from possible injury resulting from contact with the sharp edges of the tab 3.

In assembly of the end closure, the tether 12 is folded under the nose portion **3*a* and toward the rupturing member 7. The rivet 2 passes through the slot 13 and engages the panel member 10. To open the closure, the grasping portion 3*b* of the tab 3 is lifted away from the end panel 1, thereby impressing a panelward force on the rupturing member 7 of the nose portion 3*a* and resulting in rupture of the score line 4. Continued lifting of the grasping portion 3*b* results in controlled tearing of the end panel 1 along the score line 4. During the operation, the tab 3 pivots initially about the point of contact between the rupturing member 7 and the end panel 1. As the end panel 1 tears, the fulcrum is located on a line connecting the ends of the torn portion of the score line 4**.

As the tab 3 is rotated, the unslit area **8*c* of the panel member perimeter is subjected to a tensile stress. In the prior art end closure, which lacked a tether 12, this stress occasionally resulted in tearing of the tab area 8*c*** and malfunction of the closure.

In the end closure of the present invention, the tether 12 is initially in a slack condition, with the rivet 2 abutting the end of the slot 13 further from the rupturing member 7. As the tab 3 is lifted, the tether 12 is drawn back until the rivet 2 abuts the end of the slot 13 nearer the rupturing member 7 just prior to rupture of the score line 4. Continued lifting of the tab 3 beyond a predetermined angular displacement results in stressing of the tether 12. Thus, the stresses formerly impressed on the unslit area **8*c* are now partially borne by the tether 12. This reduction of the stress loading on the area 8*c*** prevents tearing thereof.

I claim:

1. An improved easy-opening end closure of the type comprising an end panel and a pull tab, said end panel having a score line formed therein defining an opening flap and also having tab securing means, said pull tab comprising a nose portion and a grasping portion, said nose portion having means for rupturing said score line consequent to a predetermined displacement of said pull tab relative to said end panel and further having an integrally formed hingeable panel member cooperating with said securing means to attach said pull tab to said end panel; the improvement comprising a force-distribution tether reacting between said pull tab and said securing means to ameliorate stresses on said hingeable panel member during opening of said closure, said tab securing means comprising a rivet integrally formed in said end panel, said pull tab being completely formed from a single piece of sheet material and said tether being provided by material displaced to form said grasping portion of said pull tab.

2. The invention according to claim 1, wherein said tether is folded under said nose portion and toward said rupturing means.

3. The invention according to claim 2, wherein said tether is formed with a slot elongated along the axis of said pull tab and said rivet passes through said slot.

4. The invention according to claim 3, wherein the shank of said rivet abuts the end of said slot further from said rupturing means when said end closure is in the unopened condition and said rivet shank abuts the end of said slot proximate said rupturing means when said end closure is in the opened condition, the movement of said tether permitting a predetermined limited angular displacement of said pull tab relative to said end panel.

5. The invention according to claim 4, wherein said tether is in a slack state prior to opening of said end closure and is formed and arranged to be loaded in tension prior to rupture of said score line.

6. An improved easy-opening end closure comprising an end panel and a pull tab attached thereto, said pull tab comprising a nose portion and a grasping portion, said nose portion having a hingeable panel member therein, and a force-distributing tether integrally formed with said pull tab and attached to said end panel whereby the stresses impressed on said panel member during opening of said end closure are reduced and tearing thereof is prevented, said tether being in substantially underposed relation with said nose portion and further being in a slack state prior to opening of said end closure, said pull tab being rotatable to load said tether in tension prior to rupture of said score line.

7. An improved pull tab for an easy-opening end closure, comprising a nose portion and a grasping portion, said nose portion having a hingeable panel member therein, and a force-distributing tether integrally formed with said pull tab and having means for connection with said hingeable member to an associated end panel, said nose portion being formed with a generally U-shaped slit defining said hingeable panel member therein, said panel member being integrally attached to said pull tab by an unslit hinge-forming portion of the panel member periphery, said tether having a connection with said grasping portion and serving as a load transmitting means between said grasping portion and an associated panel in an area of connection between the end panel and said hingeable panel member to reduce the stresses impressed on said unslit portion of said panel member periphery during opening of said end closure to prevent tearing thereof.

8. The invention according to claim 7, wherein said tether includes means for providing a lost motion connection between said tether and an end panel accommodating initial tilting of said pull tab and thereafter transferring opening force from said pull tab to said end panel.

9. The invention according to claim 7, wherein said pull tab is completely formed from a single piece of sheet metal and said tether is provided by metal cut from said grasping portion.

10. The invention according to claim 8, wherein said tether is symmetrically disposed relative to the longitudinal axis of said pull tab.

* * * * *